US005344355A

United States Patent [19]

Silverstein

[11] Patent Number: 5,344,355

[45] Date of Patent: Sep. 6, 1994

[54] TOY WITH DETACHABLE PACIFIER

[76] Inventor: Sharyn G. Silverstein, 526 Bedford Park Ave., North York, Ontario, Canada, M5M 1K3

[21] Appl. No.: 193,931

[22] Filed: Feb. 9, 1994

[51] Int. Cl.[5] ..... A63H 3/00

[52] U.S. Cl. ..... 446/72; 446/268; 606/234

[58] Field of Search ..... 446/71, 72, 227, 268, 446/304; 606/234, 235, 236

[56] References Cited

U.S. PATENT DOCUMENTS

| | | | |
|---|---|---|---|
| 3,392,729 | 7/1968 | Lenoir | 606/234 |
| 4,188,747 | 2/1980 | Kramer | 46/116 |
| 4,277,910 | 7/1981 | Kramer | 46/116 |
| 4,697,589 | 10/1987 | King et al. | 606/234 |
| 4,765,037 | 8/1988 | Perry | 606/234 |
| 4,994,075 | 2/1991 | Smith et al. | 606/235 |
| 5,201,073 | 4/1993 | Spanier | 446/28 |

*Primary Examiner*—Robert A. Hafer
*Assistant Examiner*—Jeffrey D. Carlson

[57] ABSTRACT

The invention comprises a stuffed toy (doll or animal) with a flexible extension member and pacifier retaining loop extending off and away from the toy, in the form of a hat or tail, for attachment and detachment of the pacifier to the doll. The pacifier may then be sterilized and the doll or animal laundered. The pacifier retaining loop is fed through the ring of the pacifier. The end of the pacifier retaining loop, which has a snap or hook attached to it, is then fed through a small opening in the back of the extension member. The snap on the end of the pacifier retaining loop snaps onto a receiving snap button which is attached to the inside of the extension member. The parent accesses the inside of the extension member in order to attach or detach the pacifier through a VELCRO TM lined opening situated in the back of the extension member.

5 Claims, 4 Drawing Sheets

TOY WITH DETACHABLE PACIFIER

BACKGROUND OF THE INVENTION

This invention relates generally to stuffed toy figures—dolls or animals—with a detachable pacifier. The purpose of the invention is to provide convenience, control and weaning assistance to parents whose infants or children use a pacifier. A further purpose of the invention is to allow maximum breathing and vision capabilities to infants while using a pacifier/toy combination. The invention further provides pacification, entertainment and play to infants or small children.

The pacifier, comprised of a variety of materials, has long been used to soothe the oral demands of infants or small children during irritable periods by providing them with an object to suck on in place of a bottle or breast in between feedings. Use of a pacifier has been shown to calm the irritability of a child.

When a pacifier is combined with a toy, the eventual weaning or elimination of the pacifier is less traumatic for the child. When the parent weans the child from the pacifier, the child still has the comfort of the doll which it has associated with comfort since infancy when the child started using a pacifier. The child will first look for the pacifier, but quickly accept the toy or doll on its own without the pacifier.

Infant-pacifier combinations have been previously developed. It was recognized that there are advantages to attaching a pacifier to a toy in addition to those relating to weaning mentioned above. The child is provided with comfort from the pacifier and toy at the same time. Additionally, the connection of the pacifier to the doll prevents the pacifier from becoming readily damaged or dirtied while the pacifier may still be easily removed for cleaning and sterilizing.

It is recognized that in fastening the pacifier to the toy, safety is a critical consideration. This safety factor precludes a simple means of attachment such as tying the pacifier around a child's neck or simply attaching string or elastic with a pacifier on the end to the doll's body, which may cause strangulation. Thus, any toy/-pacifier combination must provide the advantages described above in a safe and convenient manner. The means of attachment is the key element in achieving these goals.

In a previous combination, as, for example, illustrated by U.S. Pat. No. 4,277,910, the pacifier is attached directly to the body of the toy by means of a receptacle on the body of the toy itself (i.e. the nose). This means of attachment does not require small-finger movements for detachment of the pacifier, which may therefore be pulled off the toy by a child using the combination. The child could then easily drop and dirty or lose the pacifier. In addition, since the pacifier is attached directly to the body of the toy, the child cannot comfortably hug the toy or lie in bed with the toy away from her face while the pacifier is in her mouth. Thus, when the child is using the pacifier, the doll is positioned directly and closely in the infant's face, obstructing both vision and breathing. One of the primary advantages to this invention is the length and flexibility of the means of attachment of the pacifier which allows for maximum undisturbed sleeping and breathing comfort for the infant and allows for the use of the pacifier with a full range of vision while upright or in any sleeping position.

In the previous combination cited above, an infant would be unable to comfortably sleep on either her back or stomach while using the combination. If the infant slept on her back and wished to use the pacifier, the toy or animal would necessarily be positioned on or near the face of the infant obstructing vision and breathing. If the infant slept on her stomach, with head turned to the side, and attempted to use the pacifier, vision and breathing obstruction would result along with the probable improper and harmful fit of the pacifier in the infant's mouth, because of the awkward inflexibility of the receptacle form of attachment. By contrast, in the present invention, the infant can comfortably sleep in any position while using the pacifier and holding the doll (or not holding the doll) because the means of attachment flexibly extends away from the doll and there is, therefore, no physical interference with the infant's breathing or vision while in any sleeping position. The proper air circulation near the infant's face accomplished with this invention, as opposed to the breathing obstruction likely in the other combination, is important from a health, safety and comfort standpoint. There is increasing recognition within the medical literature of the adverse effects on infants of obstructed breathing caused by excessive blankets or otherwise, which promote the harmful concentration of carbon dioxide around the infant's face. The present invention eliminates this concern because of the flexible extension which results in the body of the doll being away from the child's face. The flexible extension also allows the child to have unobstructed vision while walking (important for safety reasons) or lying in the crib (important for unimpaired visual stimulation).

An additional improvement and advantage of the present combination is that, unlike the previous combination, the pacifier cannot be removed by the child alone. An illustration of the practical importance of this is nighttime pacifier use. If the child can pull the pacifier off by herself, the pacifier may then fall out of the crib. If, however, the pacifier cannot be detached by the child, it will always stay in the crib with the doll and can be easily found. Consequently, parents will not be beckoned during the night as often because of dropped or misplaced pacifiers or crying infants.

Lastly, in the previous combination, the aesthetic effect when the pacifier is removed is displeasing and awkward since the removal of the pacifier leaves an empty receptacle on the doll or animal with no purpose. In the present invention the doll looks absolutely normal with no unnatural appearing empty spaces when the pacifier is removed.

What is needed, then, is a means of attachment of the pacifier to the toy for improving breathing and sleeping comfort and safety; aesthetics; function; and parental control over the attachment and detachment of the pacifier that is secure enough so that it cannot be lost, dropped or pulled off the doll by the child. Also needed is an attachment mechanism whereby the pacifier is able to be detached by the parent only for laundering of the doll and sterilization of the pacifier. Finally, the combination should in no way obstruct the breathing and vision of the infant and the doll should look perfectly normal without the pacifier.

To the inventor's knowledge, the previous combination cited above is not currently being sold at major retail toy outlets. The deficiencies of the previous combination outlined above, which are overcome and corrected in the present invention, may have contributed to its lack of commercial success.

BRIEF SUMMARY OF THE INVENTION

The invention broadly comprises a soft stuffed toy with a pacifier attachable and detachable by an adult only, with such pacifier attached through a loop at the end of a piece of flexible fabric extending away from the doll's body.

A primary object of the invention is to provide a simple new child-proof method of attachment and detachment whereby only the parent can detach the pacifier from the doll so that the child cannot detach and lose the pacifier by manipulation or pulling.

A further object of the invention is to provide functionally and aesthetically, a new and improved manner of attaching a pacifier object to a stuffed toy, such that when the child sucks on the pacifier, the toy is not positioned against the face of the infant obstructing both vision and breathing, but rather extends away form the child so that he/she can comfortably see, breathe and embrace the toy in any awakened or sleeping position, while at the same time sucking on the pacifier.

A final object of the invention is to provide a combination that looks whole, complete and aesthetically pleasing when the pacifier is removed from the toy.

Additional objects, advantages and novel features of the invention will be set forth in part in the description which follows, and in part will become apparent to those skilled in the art upon examination of the following or may be learned by practice of the invention. The objects and advantages of the invention may be realized and obtained by means of the instrumentality and combinations particularly pointed out in the attendant claims.

DETAILED DESCRIPTION OF THE INVENTION

A portion of the disclosure of this patent document contains material which is subject to copyright protection. The copyright owners have no objection to the facsimile reproduction of any one of the patent disclosures, as it appears in the Patent and Trademark Office patent files on record, but otherwise reserves all copyright rights whatsoever.

Figure 1:
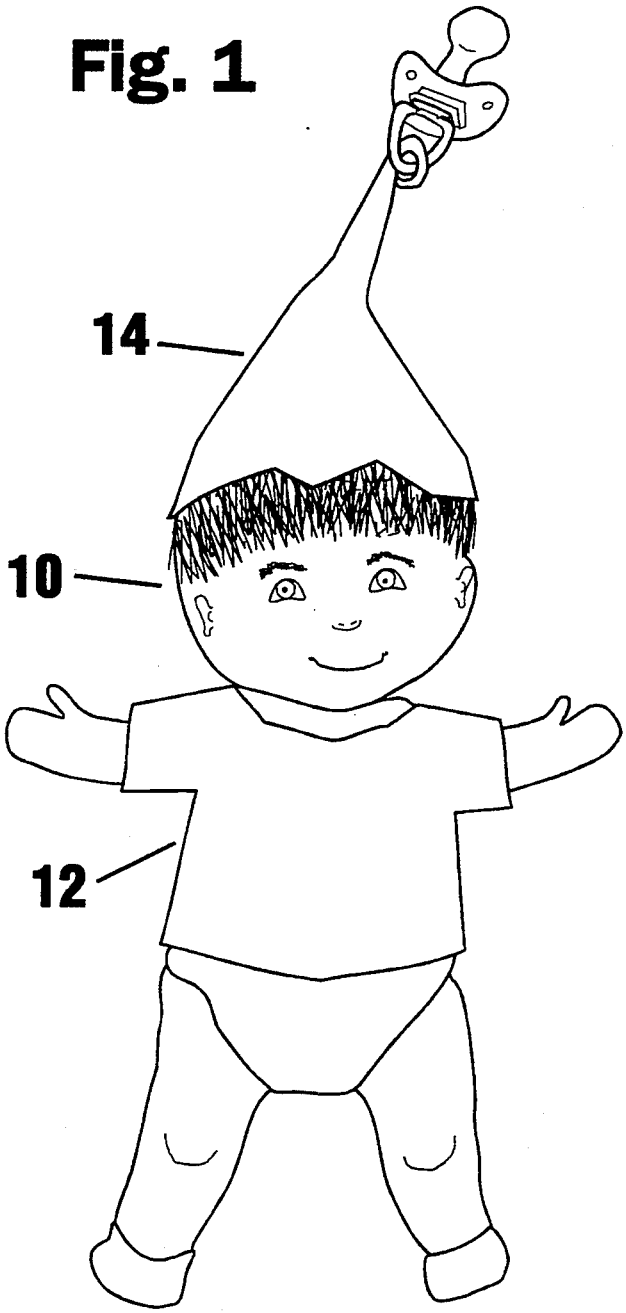
FIG. 1 illustrates a front view of a doll showing the pacifier attached to and extending from the hat of the doll.

FIG. 1 shows a doll-like toy object. The toy object is preferably any soft, stuffed animal or doll which is attractive to children and may comfortably be embraced and hugged by an infant or small child. The toy object possesses a head 10 with a trunk-like body member 12. Variations in the toy are unlimited so long as each has extensions extending away from the body and may include a doll with a hat 14 or an animal with a tail.

Figure 2:
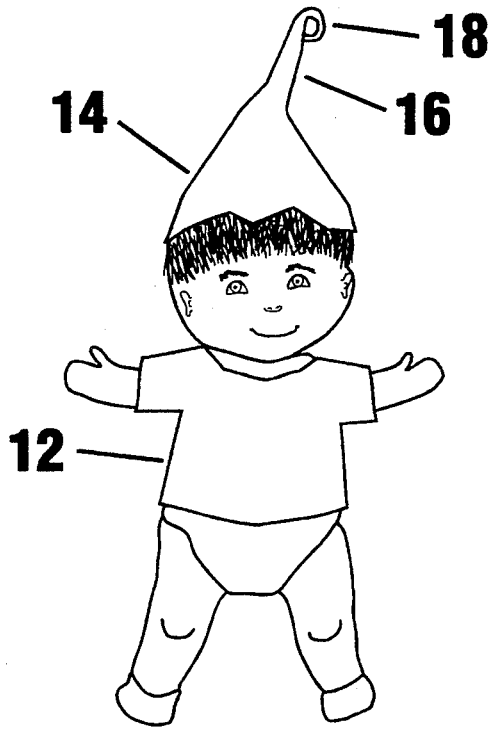
FIG. 2 illustrates a view of the doll without the pacifier attached.
Figure 3:
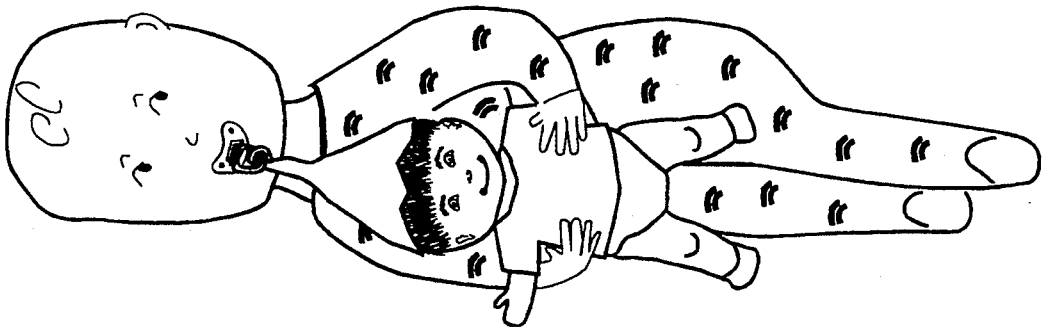
FIG. 3 illustrates a view of a child hugging the doll with the pacifier in her mouth while lying in a reclined position.
Figure 4:
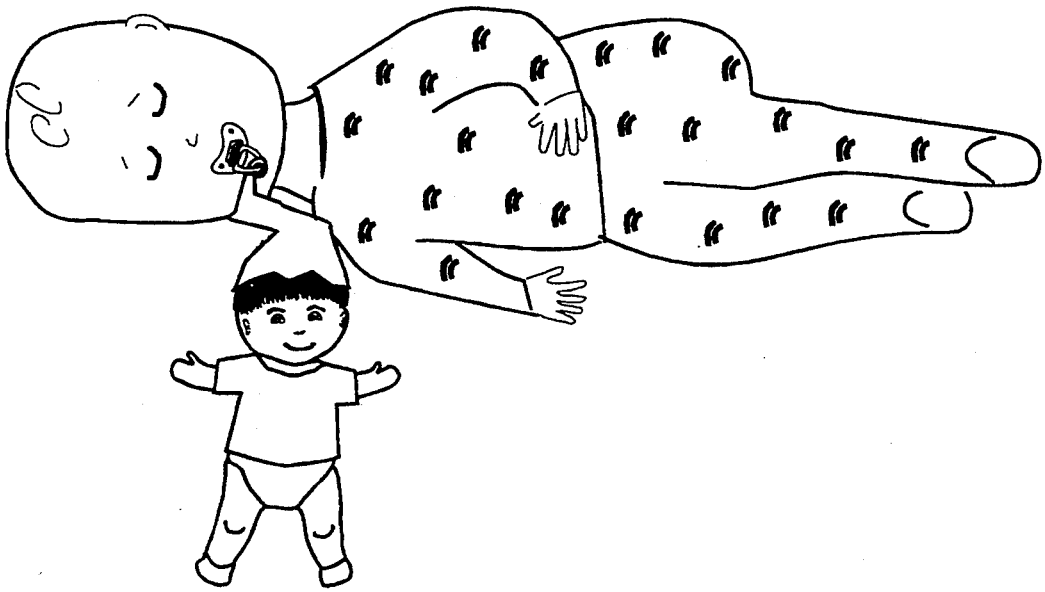
FIG. 4 illustrates a view of a child with the pacifier in her mouth sleeping in a reclined position with the doll lying freely away from her body.
Figure 5:
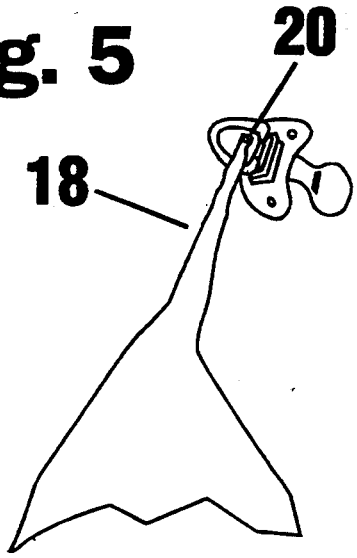
FIG. 5 illustrates the pacifier retaining loop with a snap button on the end positioned to feed through the pacifier ring.
Figure 6:
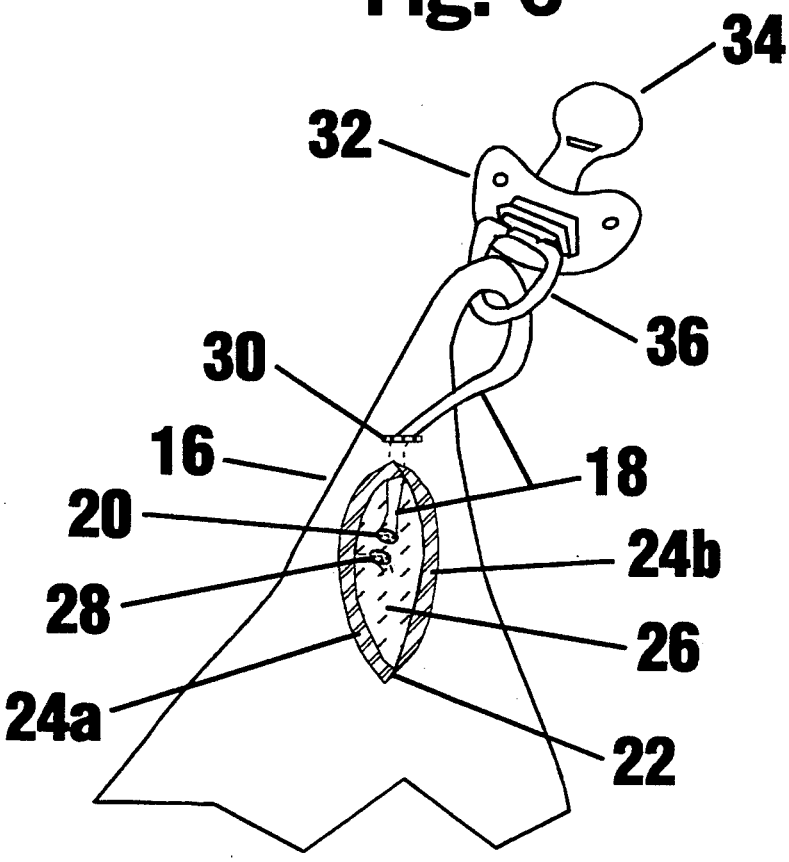
FIG. 6 illustrates how the pacifier retaining loop passes through the button-hole to the interior of the hat and also shows how the VELCRO® opening to the fabric allows the finger access to the interior so that the snap buttons may be snapped together.
Figure 8:
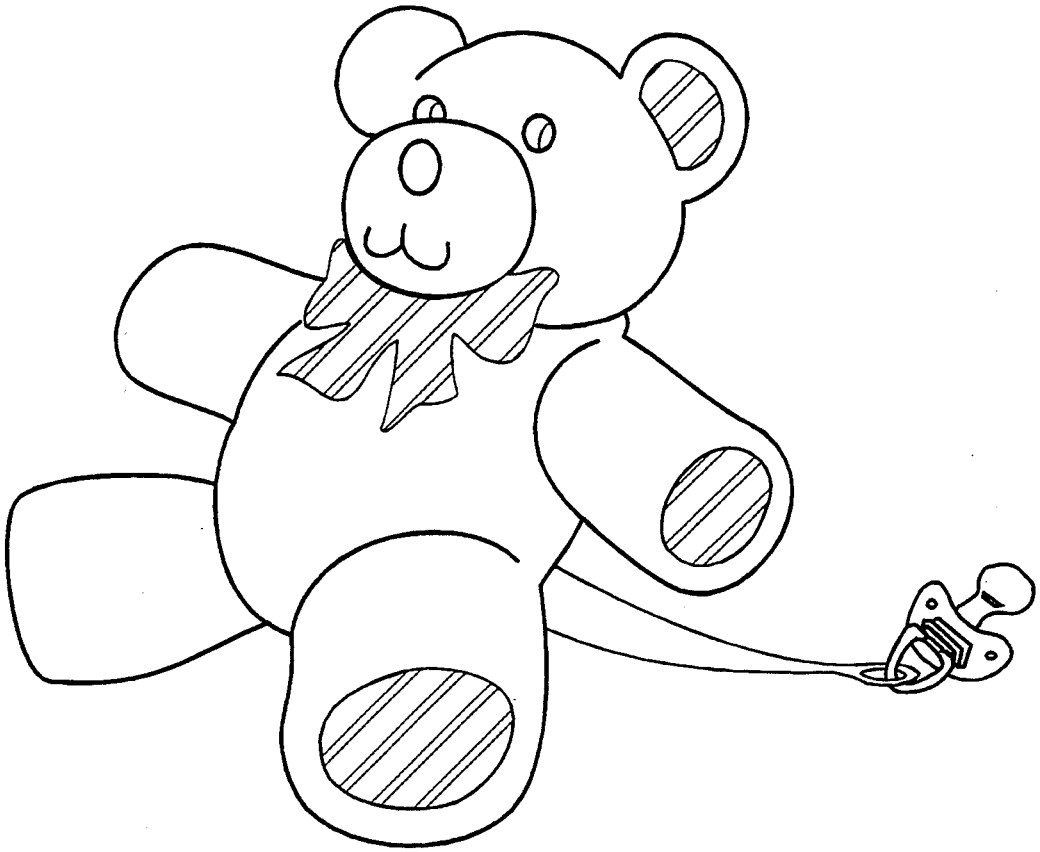
FIG. 8 illustrates an alternate embodiment of the invention.

As shown in FIG. 2, the invention has a single piece extension member 16, with the front and back closed in such a way as to form a cylinder with an interior, here depicted as a hat 14, attached to and extending off of the body 12 of the doll or animal. The preferable material is any soft, flexible, fire-resistant material although any material may be used which may be closed in such a way as to form a cylinder with an interior space. As shown in FIG. 2, the pacifier retaining loop 18, a narrow single rounded piece made of the same material as the extension member is attached to the extension member 16. FIG. 5 shows a retaining means of attachment 20 is affixed at the tip of the pacifier retaining loop 18. As shown, the retaining means of attachment 20 is a snap, but any other suitable fastening means such as a hook, hook-and-loop fastener means known as VELCRO TM, tie or button may be used in its place. As shown, the snap 20 is attached to the pacifier retaining loop by stitching, but may, of course, be secured by any other safe and appropriate means. FIG. 6 shows that the extension member 16 has a lateral opening 22 which extends horizontally. The lateral opening 22 possesses VELCRO TM parts **24*a* and 24*b* on opposite sides of the opening which engage and disengage for opening and closing. As shown, the parts 24*a* and 24*b* have VELCRO TM attached to the full length of the strips. The VELCRO TM parts 24*a* and 24*b* are attached to the opposite sides by stitching, but may be secured by other appropriate means. Other suitable fastening means may be used in place of the VELCRO TM parts 24*a* and 24*b***, such as snaps, buttons or ties.

The lateral opening 22 in the extension member 16 permits access to the interior 26 of the extension member 16 in which is affixed a receiving means of attachment 28 engaging with the retaining means of attachment 20 attached to the end of the pacifier retaining loop 18. The manner of affixing the receiving means of attachment and the type and range of receiving means of attachment is the same as, and complements the retaining means of attachment 20 of the pacifier retaining loop 18.

Figure 7:
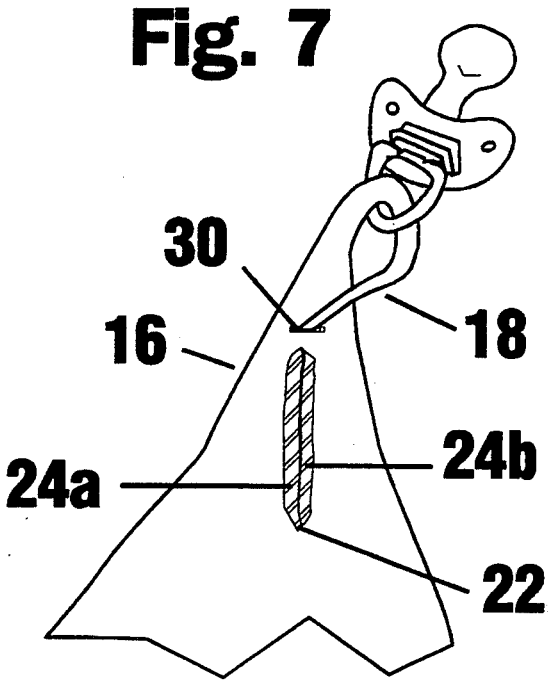
FIG. 7 illustrates the pacifier attached to the hat by the pacifier retaining loop with the VELCRO® opening closed to hide the snaps inside the hat.

As shown in FIGS. 6 and 7 the extension member 16 has in its back piece, situated directly below the pacifier retaining loop 18, a button-hole 30 of a compatible size to accommodate the insertion of the pacifier retaining loop 18. Once passed through the button-hole 30 the retaining means of attachment 20 of the pacifier retaining loop 18 then engages with or attaches to the receiving means of attachment 28, fastened to the interior 26 of the extension member 16 as shown in FIG. 6.

The pacifier 32 has a nipple 34 at the one end and a ring 36 at the opposite end through which is fed the pacifier retaining loop 18.

As can be seen from the foregoing description, the present invention provides a child-proof way of fastening a pacifier to a doll in such a way that only an adult will be able to remove the pacifier, for washing and replacement of the pacifier, and laundering of the doll.

Because the attachment and detachment of the pacifier requires threading, snapping and other small finger movements that a child is unlikely to accomplish, the incidence of lost pacifiers or disconnected pacifiers which become soiled will be reduced in that the child will be unable to remove the pacifier unassisted by an adult. During the night, the child will not lose the pacifier through the bars of the crib, and he/she will be able to easily locate the pacifier simply by locating any part of the doll. Further, because the pacifier is attached as a natural extension from the toy and not attached directly to the toy, the child is not forced to position the toy directly up against his or her face obstructing vision and breathing in order to use the pacifier. This is particularly helpful when the child is lying down to sleep with the doll.

While a particular embodiment of the invention has been shown and described, various modifications thereof will be apparent to those skilled in the art and, therefore, it is not intended that the invention be limited to the disclosed embodiment or to the details thereof, and departures may be made therefrom within the spirit and scope of the invention as defined in the appended claims.

What is claimed is:

1. A toy-pacifier combination in the form of a doll or animal capable of being held by an infant or small child comprising:

(a) an extension member attached at one end to the body of the toy and extending outwardly away from said body gradually narrowing to a distal end, said extension member having a front surface and a back surface formed into a hollow cylinder;

(b) a pacifier retaining loop at said distal end of said extension member forming a unitary construction with said extension member;

(c) a retaining means of attachment affixed to the tip of said pacifier retaining loop;

(d) a receiving means of attachment engageable to said retaining means of attachment affixed to the interior of said front surface of said extension member;

(e) a pacifier member having a nipple protrusion on one end and a ring member on the opposite end; and (f) said extension member back surface having a lateral opening allowing access to the interior of said extension member, said lateral opening having two sides lined with mutually engageable means of attachment on opposing parts adapted to engage each other, said extension member back surface additionally having a button-hole positioned below said pacifier retaining loop so that said pacifier retaining loop may be fed through said pacifier ring member and then passed through said button-hole for the purpose of attaching said retaining means of attachment to said receiving means of attachment.

2. A toy-pacifier combination as in claim 1 wherein said extension member is in the form of a hat.

3. A toy-pacifier combination as in claim 1 wherein said extension member is mn the form of a tail.

4. A toy-pacifier combination as in claim 1 wherein said retaining and receiving means of attachment consist of a snap, hook or hook-and-loop fastener.

5. A toy-pacifier combination as in claim 1 wherein said means of attachment on opposing parts of said lateral opening in said extension member consist of a snap, hook or hook-and-loop fastener.

* * * * *